United States Patent [19]

Seufert

[11] Patent Number: 4,523,986

[45] Date of Patent: Jun. 18, 1985

[54] LIQUEFACTION OF COAL

[75] Inventor: Frederick B. Seufert, Bedford Hills, N.Y.

[73] Assignee: Texaco Development Corporation, White Plains, N.Y.

[21] Appl. No.: 562,345

[22] Filed: Dec. 16, 1983

[51] Int. Cl.[3] ..... C10G 1/06; C10G 1/00

[52] U.S. Cl. ..... 208/10; 208/8 LE; 208/11 LE

[58] Field of Search ..... 208/8 LE, 10, 11 LE

[56] References Cited

U.S. PATENT DOCUMENTS

| | | | |
|---|---|---|---|
| 3,477,941 | 11/1969 | Nelson | 208/8 LE |
| 3,519,554 | 7/1970 | Stotles et al. | 208/10 |
| 3,867,275 | 2/1975 | Glein et al. | 208/8 LE |
| 4,097,361 | 6/1978 | Ashworth | 208/10 |
| 4,189,371 | 2/1980 | Maa et al. | 208/8 LE |
| 4,191,700 | 3/1980 | Lebowitz et al. | 208/8 LE X |
| 4,203,823 | 5/1980 | Carr et al. | 208/10 |
| 4,230,556 | 10/1980 | Carr et al. | 208/10 |
| 4,440,620 | 4/1984 | Derbyshire et al. | 585/733 X |

*Primary Examiner*—William G. Wright

*Attorney, Agent, or Firm*—Robert A. Kulason; Albert Brent

[57] ABSTRACT

Coal or similar solid carbonaceous fuels are liquefied by catalytic hydrogenation of coal-liquid hydrocarbon oil slurries with a hydrogen-rich gas. Both the liquid hydrocarbon slurrying oil and the hydrogen-rich gas are derived in the process. Noxious hydrogen-containing purge and vent gases and optionally high ash-containing bottoms from a vacuum fractionator are used as feed to a partial oxidation gas generator to produce synthesis gas from which the hydrogen-rich gas is derived.

25 Claims, 2 Drawing Figures

LIQUEFACTION OF COAL

BACKGROUND OF THE INVENTION

This invention relates to a process for liquefying coal or similar solid carbonaceous fuels. More particularly, this invention relates to a coal liquefaction process employing process derived hydrogen-rich gas made by the partial oxidation of purge and vent hydrogen-containing gases, optionally in admixture with a vacuum bottom stream containing ash.

Coal will emerge as an increasingly important energy source by the end of the decade. It has been predicted that by 1990, the consumption of coal among western industrialized nations will have grown by 47%. There are ample coal supplies in the United States, Canada, and Australia to meet this growing demand. Liquefaction of coal to produce liquid fuels and chemical by-products will become increasingly important, especially when petroleum supplies become uncertain.

Methods for producing hydrocarbonaceous liquids by the solvent extraction of coal and similar carbonaceous materials are well known. Both catalytic and non-catalytic processes have been devised for digesting the coal in a coal hydrogenation reactor. For example, reference is made to U.S. Pat. Nos. 3,477,941; 3,519,553; 3,519,554; 3,519,555; 3,867,275; and 4,189,371.

Hydrogen for the hydrogenation reactor in these systems is commonly made by the catalytic steam reforming of natural gas or gaseous ends. However, this is uneconomical since either an additional pure gaseous fuel must be imported into the system, or costly gas purification is required before the gaseous ends may be used in the catalytic steam reformer. Also, the yield of such gaseous fuels after purification may be insufficient to produce the required amount of hydrogen. The multihydrotorting of coal-water slurries with gaseous mixtures comprising $H_2+CO$ as produced by the partial oxidation of coal char is described in coassigned U.S. Pat. Nos. 3,715,195 and 3,715,301. The partial oxidation of slurries of oil, water and unconverted carbon is described in coassigned U.S. Pat. No. 3,528,930. While the partial oxidation of coal or liquefaction bottoms has been accomplished, the cost of the steam temperature moderator may be an economic penalty. Further, it would be uneconomical to burn up substantial amounts of the feed coal or the valuable liquid hydrocarbon products to make hydrogen. Also, there would still remain the problem and cost of disposing of the noxious vent and purge gases produced in the liquefaction step.

In the subject process, preferably no supplemental water or steam is required; and the noxious vent and purge gases are readily disposed of in the gas generator in an environmentally acceptable manner.

Advantageously, by the subject process catalytic steam reforming requiring costly gas purification steps is eliminated. Noxious vent and purge gas streams and optionally high ash-containing vacuum bottom streams may now be advantageously used as feedstock to obtain hydrogen for use in the subject solvent coal liquefaction process.

BRIEF DESCRIPTION OF THE DRAWING

In order to illustrate the invention in greater detail, reference is made to a preferred embodiment shown in the accompanying drawing.

DESCRIPTION OF THE INVENTION

Figure 1A:
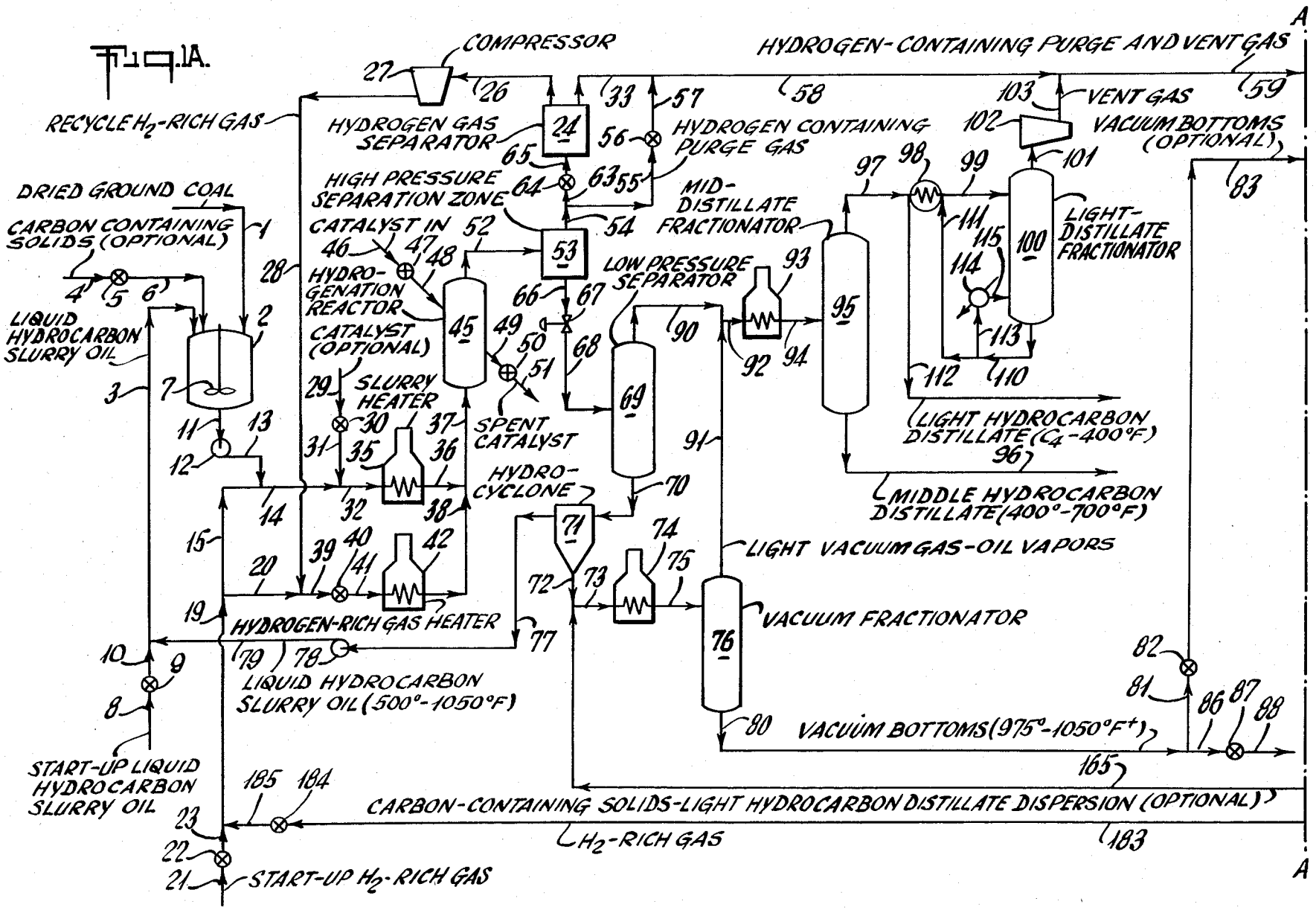
FIG. 1A is a schematic representation of a preferred embodiment of the process for the liquefaction of dried ground coal using process derived liquid hydrocarbon slurry oil and hydrogen-rich gas.

A more complete understanding of the invention may be had by reference to the accompanying schematic drawing which depicts a process for the liquefaction of coal using process produced coal-derived recycle solvent and hydrogen-rich gas. Although the drawing illustrates a preferred embodiment of the invention, it is not intended to limit the subject invention by the particular apparatus or materials described. The words "similar liquefiable carbonaceous solids" where they appear in the following description are synonymous with the word "coal".

Dried ground coal or similar solid carbonaceous fuel suitable for use in the subject process is passed through line 1 (FIG. 1A of the drawing) and into mixing tank 2 where it is mixed with process derived liquid hydrocarbon slurry oil from line 3, and optionally with dried and pulverized carbon-containing solids from line 4, valve 5, and line 6. Thorough mixing of the ingredients in tank 2 may be accomplished with mixing propeller 7. Start-up liquid hydrocarbon slurry oil may be introduced into the system through line 8, valve 9, and line 10. The concentration of solids in the resulting pumpable slurry which leaves tank 2 through line 11 is in the range of about 50 to 80 weight percent (wt. %), such as about 60 to 70 wt. %. The coal particles have a particle size in the range of about ASTM E 11-70 Sieve Designation Standard 300 μm (Nominal Sieve Opening 0.0117 inches) to Standard 53 μm (Nominal Sieve Opening 0.0021 inches). The coal or similar liquefiable carbonaceous solids is selected from the group consisting of bituminous coal, sub-bituminous coal, anthracite coal, lignite, tar sands, oil shale, and mixtures thereof.

Figure 1B:
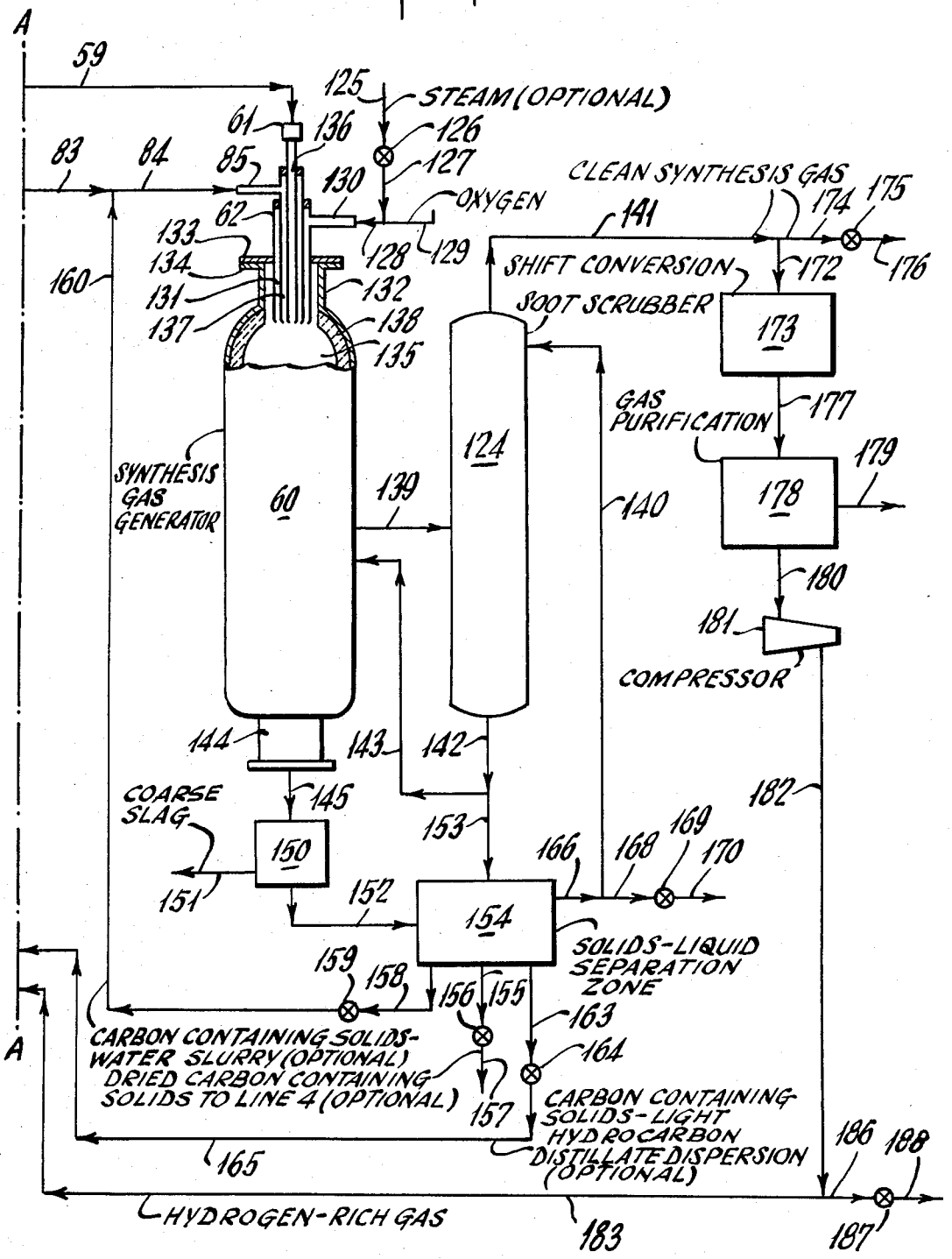
FIG. 1B as shown to the right of vertical line A-A is a schematic representation of the partial oxidation zone where the hydrogen-rich gas used in FIG. 1A is produced from vent and purge gases, and optionally the hydrocarbonaceous ash-containing bottoms product from a vacuum fractionation zone.

The coal-liquid hydrocarbon slurry oil in line 11 is pumped by means of pump 12 through line 13 and mixed in line 14 with hydrogen-rich gas from line 15. The hydrogen-rich gas stream is produced downstream in the partial oxidation gas generating zone shown in FIG. 1B of the drawing. Thus, starting in line 180 of FIG. 1B, the hydrogen-rich gas is compressed in compressor 181 and passed through lines 182, 183, valve 184, and line 185 to line 19 of FIG. 1A. Optionally, the hydrogen-rich gas stream in line 19 is split between lines 15 and 20. For example, from about 10-100 volume %, such as about 25-75 volume % of the $H_2$-rich gas stream is passed through line 15 and the remainder, if any, is passed through line 20. Start-up hydrogen-rich gas is introduced into the system through line 21, valve 22, and line 23.

Optionally, a hydrogenation catalyst in line 29 may be passed through valve 30, line 31, and mixed in line 32 with the mixture of hydrogen-rich gas and coal-liquid hydrocarbon oil slurry from line 14. Any suitable conventional hydrogenation catalyst may be used such as compounds containing cobalt, molybdenum, palladium, nickel, tin, tungsten, and mixtures thereof; such as finely divided cobalt-molybdate catalyst or palladium deposited on a base of the class alumina, magnesia, silica, and the like.

The feed mixture in line 32 is preheated in slurry heater 35 to a temperature in the range of about 700° to 950° F., such as about 800° to 900° F. without vaporizing the liquid hydrocarbon slurry oil and then passed through lines 36 and 37. In line 37 the mixture may be optionally mixed with additional hydrogen-rich gas from line 38. The hydrogen-rich gas in line 38 comprises from 0–100 volume %, such as about 25–75 volume % of recycle hydrogen-rich gas from $H_2$-gas separator 24, line 26, recycle $H_2$-compressor 27, line 28 and the remainder, if any, comprises the split stream of hydrogen-rich gas from line 20. Hydrogen gas separator 24 comprises any suitable conventional gas-gas separator e.g. solvent, membrane etc. These two hydrogen-rich gas streams are mixed in line 39. The mixture is then passed through valve 40, line 41, heater 42, line 38 and into line 37. The temperature of the hydrogen-rich gas in line 38 and the three-phase mixture in line 36 are about the same. The three-phase mixture in line 37 comprises about 1,000 to 100,000, such as about 2000 to 15,000 Standard Cubic Feet (SCF) of hydrogen-rich gas per barrel (bbl) of coal-liquid hydrocarbon oil slurry. From about 10–100 volume %, such as about 40–80 vol. % of the hydrogen-rich gas in line 37 may be composed of make-up hydrogen-rich gas from line 19. The remainder is supplied by recycle $H_2$-rich gas from line 28. The term $H_2$-rich gas stream as employed herein means a gas stream comprising at least 95 mole % hydrogen, or higher, such as 98.0 mole % $H_2$.

The three-phase mixture of hydrogen-rich gas and coal-liquid hydrocarbon oil slurry in line 37 is introduced into a conventional hydrogenation reactor 45, with or without admixture with a catalyst. In one embodiment, the feed is passed up through a fluidized or ebullated bed reactor. Instead of adding the catalyst to the slurry by way of line 31, the hydrogenation catalyst may be optionally introduced into reactor 45 through line 46, valve 47, and line 48. Spent catalyst may be periodically removed through line 49, valve 50, line 51 and sent to a catalyst reclamation facility. Ash and unreacted coal particles are carried out with the effluent through overhead line 52.

The digestion reaction takes place in at least one hydrotreating reactor 45 each operating at a temperature in the range of about 750° to 950° F., such as about 800° to 850° F.; a pressure in the range of about 0 to 300 atmospheres, such as about 50 to 225 atmospheres; and a residence time in the range of about 2 to 75 minutes, such as about 10 to 60 minutes. The space velocity expressed as the pounds of reactants, liquid hydrocarbon slurry oil and $H_2$-rich gas charged per hour divided by the volume of the reactor employed may be in the range of about 10 to 100, such as 20 to 30. There may be 0 to 20, such as about 2 to 10 lbs. of catalyst per ton of dry coal. The operating conditions are chosen so as to maintain the coal slurry and the dissolved coal in substantially liquid phase. While one reactor 45 is shown and described herein, it is understood that the hydrogenation reaction zone may comprise one or more reactors. For example optionally to achieve greater conversion into low molecular weight liquids the effluent may be passed through a plurality of hydrogenation reactors connected in series and/or parallel, e.g. multi-stage liquefaction.

The liquefaction effluent from the hydrogenation zone in line 52 comprises a mixture of vapors and liquids. The mixture of gaseous products are first separated from the mixture of liquid products in high pressure separation zone 53. High pressure separation zone 53 comprises one or more separating vessels and coolers in series operating at substantially the same pressure as hydrogenation reactor 45. The stream of gaseous liquefaction products in line 23 may comprise the following:

TABLE I

GASEOUS PRODUCTS FROM LIQUEFACTION REACTOR, LINE 54

| | Mole % |
|---|---|
| $H_2$ | 30 to 60 |
| $H_2S$ + COS | 1 to 5 |
| $NH_3$ | 0.01 to 0.5 |
| $N_2$ | 1 to 5.0 |
| $CH_4$ | 25 to 50 |
| $C_2H_4$ | 0.5 to 2.0 |
| $C_2H_6$ | 10 to 25 |
| $C_3H_6$ | .01 to .5 |
| $C_3H_8$ | 0.5 to 5.0 |
| $C_4H_{10}$ | 0.01 to 1.0 |
| CO | 2 to 10 |
| $CO_2$ | .01 to 2.0 |
| $H_2O$ | 0.1 to 2 |

In order to prevent the build-up of acid-gases in the system at least a portion, e.g., about 10–100 volume %, such as about 25–75 volume %, of the gaseous mixture in line 54 may be purged from the system. For example, the purge stream of gases may be sent to flare. Costly gas separation and purification procedures would be required to separate out the light hydrocarbon gases. Advantageously, in the subject process, at least a portion, e.g., about 25 to 100 volume %, such as about 50 to 90 volume % of the gas stream in overhead line 54 is passed through line 55, valve 56, lines 57–59 and into partial oxidation gas generator 60 by way of central inlet 61 of burner 62. By operating in this manner, in a preferred embodiment with only hydrogen-containing gaseous feed no supplemental temperature moderator, e.g., steam, may be required. Further, costly gas purification equipment may be omitted from the process. In the embodiment of the process where recycle $H_2$-rich gas from line 26 is used, as previously described, the remainder of the $H_2$-containing gas stream from line 54 is passed through line 63, valve 64, and line 65 into hydrogen gas separator 24. After a portion of the hydrogen is separated, the remainder of the hydrogen-containing gas in separator 24 leaves through line 33 and is mixed with the rest of the hydrogen-containing gas in line 58.

The stream of liquid products leaving high pressure separation zone 53 through line 66 is passed through a pressure let-down zone comprising at least one pressure let-down valve and separator combination. For example, a portion of the liquid products in line 66 is vaporized by being passed through valve 67 where the pressure is reduced, line 68, and low pressure separating vessel 69, where the pressure is in the range of about 0 to 20 atmospheres, such as 5 to 15 atmospheres. The liquid stream in line 66 includes low and high molecular weight hydrocarbon liquids, unconverted coal particles, and mineral matter.

A stream of liquid hydrocarbon leaves low pressure separator 69 through line 70 at the bottom and passes into hydroclone 71. Most of the ash and solids are concentrated in the underflow stream which leaves hydroclone 71 through line 72. The underflow stream is then passed through line 73, heater 74, line 75, and into vacuum still 76. The overflow stream of hydrocarbon liquid leaving hydroclone 71 through line 77 is pumped by pump 78 through lines 79 and 3 and into mixing tank 2 for slurrying the dried ground coal, as previously described. The characteristics of the liquid hydrocarbon slurry oil from line 3 are shown in Table II.

TABLE II

LIQUID HYDROCARBON SLURRYING OIL, LINE 3

| Property | Broad | Typical |
|---|---|---|
| API Gravity | −10 to 15 | 5 |
| Initial Boiling Point °F. (ibp) | 500–650 | 500 |
| 50% (bp) °F. | 650–800 | 650 |
| End Point °F. (ep) | 975–1050 | 975 |

Optionally, at least a portion, e.g., 10–100 wt. %, such as 25–75 wt. %, and preferably substantially all of the bottom product from vacuum fractionator 767 is passed through lines 80–81, valve 82, lines 83–84, and intermediate inlet 85 of burner 62. The remainder of the bottoms product from vacuum fractionator 76, if any, may be removed through line 86, valve 87, and line 88. The bottoms product from vacuum fractionator 76 in line 80 has the characteristics shown in Table III.

TABLE III

BOTTOM PRODUCT FROM VACUUM STILL, LINE 80

| Property | Broad | Typical |
|---|---|---|
| API Gravity | −35 to 5 | −30 |
| Boiling Range °F. | 975–1050+ | 975+ |
| Ash Content, Wt. % | 0.5–40 | 25 |

The overhead vapor stream in line 90 of low pressure separator 69 and the stream of vapor in overhead line 91 of vacuum fractionator 76 are combined in line 92, preheated in fired heater 93, and then passed through line 94 into mid-distillate fractionator 95. The bottoms stream from mid-distillate fractionator 95 is removed through line 96. This is a valuable liquid hydrocarbon product and has the characteristics shown in Table IV.

TABLE IV

BOTTOMS STREAM FROM MID-DISTILLATE FRACTIONATOR, LINE 96

| Property | Broad | Typical |
|---|---|---|
| API Gravity | 0 to 15 | 10 |
| Initial Boiling Point °F. | 400–500 | 400 |
| 50% (bp) °F. | 500–600 | 550 |
| End Point °F. | 650–700 | 650 |

The overhead stream in line 97 from mid-distillate fractionator 95 is preheated in heat exchanger 98 and then passed through line 99 into light distillate fractionator 100. A stream of vent gas in overhead line 101 is compressed by compressor 102, and passed through line 103 and into line 59 where it is mixed with the stream of purge gas passing through line 58 from high pressure separator 53 and optionally hydrogen gas separator 24. The mixture of gases in line 59 is passed through burner 62, and into synthesis gas generator 60 as at least a portion of the fuel, as previously described. The composition (weight %) of the vent gas in overhead line 101 of light distillate fractionator 100 is shown in Table V.

TABLE V

COMPOSITION OF VENT GAS, LINE 101

| | Broad-Mole % | Typical-Mole % |
|---|---|---|
| Hydrogen | 20 to 70 | 42.48 |
| Ammonia | 0 to .1 | .001 |
| $CH_4$ | 10 to 40 | 33.23 |
| $C_2$–$C_4$ Hydrocarbons | 10 to 40 | 21.218 |
| $H_2S$ + COS | .1 to 1.0 | .001 |
| Inerts | 1 to 5 | 3.07 |

The stream of liquid hydrocarbon from the bottom of light distillate fractionator 100 is passed through lines 110, 111, heat exchanger 98 as the heating fluid, and leaves the system through line 112 as a valuable product. A portion of the bottoms product is recycled to light distillate fractionator 100 by way of line 113, recycle heater 114, and line 115. The liquid hydrocarbon bottoms product from stabilizer 100 has the characteristics shown in Table VI.

TABLE VI

BOTTOMS STREAM FROM LIGHT DISTILLATE FRACTIONATOR, LINE 110

| Property | Broad | Typical |
|---|---|---|
| API Gravity | 50 to 70 | 60.2 |
| Initial Boiling Point, °F. | $C_4$–200 | 200 |
| 50% (b.p.), °F. | 250–270 | 250 |
| End Point, °F. | 330–400 | 330 |

Advantageously, synthesis or hydrogen-rich gas may be produced as a valuable by-product in the subject process. Thus, all of the start-up hydrogen-rich gas from line 21 that is used in catalytic hydrogenation reactor 45 may be made on the site in partial oxidation gas generator 60. In addition, a portion of the synthesis gas may be produced for export through line 174, valve 175, line 176, or for use as fuel for the fired heaters, e.g., 35, 42, 74, and 93 in the process. Further, low cost waste products are used as a source of low cost feedstock to the hydrogen-containing gas producing zone. These feedstocks include all of the noxious purge and vent gases, e.g., from lines 58 and 101; optionally at least a portion of the high ash-containing liquid hydrocarbonaceous vacuum still bottoms stream from line 80, and optionally a slurry stream from line 160 comprising at least a portion of the soot, ash and unreacted solid carbonaceous fuel produced in gas generator 60 and soot scrubber 124, to be further described.

In the preferred embodiment of the subject process, with only hydrogen-containing gaseous feed, substantially no $H_2O$ is introduced into gas generator 60, other than that normally found in the feedstreams. This is an economic advantage, especially in those areas where there is a shortage of water. Ordinarily, steam is provided to the gasifier in the amount of about 0.1 to 5 pounds of steam per pound of fuel. Optionally, in one embodiment where a small supplemental amount of steam is introduced into the reaction zone, the steam-to-fuel weight ratio is in the range of about (0.01 to 0.08)/1. This range is still substantially below the ordinary range previously mentioned. In the embodiment where a liquid hydrocarbon fuel e.g. vacuum bottoms and/or a carbon-water slurry is introduced into synthesis gas generator 60 along with the hydrogen-containing gas stream the $H_2O$/fuel weight ratio may be in the range of about 0.2 to 5.0, such as about 0.5 to 2. In such case, steam may be passed through line 125, valve 126, line 127 and mixed in line 128 with the stream of free-oxygen containing gas from line 129. The free-oxygen containing gas in line 128, or alternatively the mixture of steam and free-oxygen containing gas in line 128 are passed through outer inlet 130 of burner 62 and down through outer annular passage 131. By definition free-oxygen containing gas comprises 95.0 mole % oxygen, or higher.

Burner 62 is vertically mounted in upper central flanged inlet 132 of gas generator 60 with its central vertical axis and that of the gas generator being coaxial. Burner flange 133 and central inlet flange 134 are bolted together making a gas-tight seal. Burner 62 is depicted as comprising three coaxial concentric spaced conduits thereby providing three separate passages for the introduction of three feedstreams into reaction zone 135. For example, the hydrogen-containing gas from line 59 may pass down through central conduit 136. When included as part of the feed, the mixture of bottoms product from the vacuum fractionator 76 and the slurry of solid carbonaceous materials from the downstream solids separation zone 154 may pass down through intermediate annualar passage 137. As previously described, the free-oxygen containing gas may pass down through outer annular passage 131. Optionally, the feedstreams may be passed through alternative passages in the burner. The three streams impact one another and intimate mixing and atomization takes place in the reaction zone. By the partial oxidation and other reactions which take place downstream from the face of the burner, a stream of raw synthesis gas is produced. For a more detailed description of a burner which is suitable for use in the subject process, reference is made to coassigned U.S. Pat. No. 3,847,564, which is herein incorporated by reference. In one embodiment, burner 62 would comprise two coaxial conduits for two feedstreams, e.g. hydrogen-containing vent and purge gas and free-oxygen containing gas. Reference is made to coassigned U.S. Pat. No. 2,928,460 which is incorporated herein by reference.

Synthesis gas generator 60 is an elongated vertical cylindrical shaped steel pressure vessel lined on the inside with thermal insulating refractory 138. The hot raw stream of synthesis gas containing a small amount of entrained particulate matter, e.g., soot, particulate carbon, slag and ash, passes freely down through the unobstructed reaction zone and is then cooled and cleaned. The partial oxidation reaction takes place at a temperature in the range of about 1700° to 3000° F. and a pressure in the range of about 1 to 250 atmospheres. A stream of hot raw effluent gas comprising $H_2$ and CO, entrained carbon-containing solids with gaseous fuels; and optionally containing ash and slag when the feed includes ash-containing liquid or solid carbonaceous fuels.

Several new variations of gas cooling and cleaning may be used to cool the hot effluent gas stream from the gas generator. For example, the hot raw gas stream may be quenched in water, in a quench tank such as shown in coassigned U.S. Pat. No. 4,218,423, which is incorporated herein by reference. Alternatively, a waste heat boiler may be used to cool the hot raw gas stream, such as shown in coassigned U.S. Pat. Nos. 3,528,930 and 3,998,609, which are incorporated herein by reference. The partially cooled raw gas stream is then cleaned by being scrubbed with water in a nozzle and/or spray column gas scrubber.

Thus in the drawing, a stream of raw synthesis gas leaves the quench section (not shown) located below reaction zone 135 of gas generator 60 by way of line 139 and passes into soot scrubber 124 where it is scrubbed with water from line 140. Clean synthesis gas leaves through line 141 at the top of soot scrubber 124, and a dispersion of water and soot leaves through bottom line 142. A portion of the soot-water dispersion is recycled to the quench zone by way of line 143. Quench water containing particulate matter such as carbon-containing solids such as soot, particulate carbon, and optionally ash and slag is removed from vessel 60 through lower central outlet 144, line 145, and introduced into coarse solids-liquid separation zone 150. There the coarse inorganic solids, e.g. slag having a diameter of about ¼" or larger, are removed. This material is discharged from the system through line 151 and used for example as landfill.

The dispersion of water and carbon-containing fine solid particles in line 152 and that in line 153 at the bottom of soot scrubber 124 are introduced into solids-liquid separation zone 154. Separation zone 154 may comprise a settler, clarifier, filter, hydroclone, decanter, and combinations thereof. Optionally, a portion, e.g., 0–100 wt. %, such as 25–75 wt. %, and preferably substantially all of the carbon-containing solids are separated from the water in separation zone 154, and then dried and recycled to mixing tank 2 by way of line 155, valve 156, and lines 157 and 4. Optionally, from 0–100 wt. %, such as 25–75 wt. % of the carbon-containing solids may be recycled as a portion of the feed to gas generator 60 by way of line 158, valve 159, and lines 160 and 84. In such case, the carbon-containing solids may be in the form of a concentrated pumpable water slurry.

In one embodiment, a decanter such as shown and described in coassigned U.S. Pat. No. 4,038,186 which is incorporated herein by reference, and a portion of the light hydrocarbon distillate from line 112, for use as the liquid organic extractant in said decanting operation, are used to separate the carbon-containing solids from the water. In such case, an overhead slurry stream of carbon-containing solids and light hydrocarbon distillate is removed from the decanter and recycled to vacuum fractionator 76 by way of line 163, valve 164, lines 165, 73, heater 74, and line 75. By this means there is no net production of carbon and the efficiency of the process is increased.

At least a portion, e.g. 10–100 Wt. %, such as 25–90 wt. %, of the water separated in solids-liquid separation zone 154 is recycled through lines 166 and 140 to soot scrubber 124 as the scrubbing fluid. The remainder of the water stream, if any, is passed through line 168, valve 169, line 170 and into a waste water treatment facility.

The cooled cleaned stream of synthesis gas leaving soot scrubber 124 by way of line 141 has the following composition: $H_2$ 10 to 55; CO 10 to 40; $H_2O$ 5 to 70; $CO_2$ 0.5 to 10; $CH_4$ 0.01 to 0.5; $NH_3$ 0.005 to 0.001; $H_2S$ 0.02 to 1.5; COS 0.01 to 0.03; $N_2$ 0.5 to 2.0; and Ar 0.05 to 1.0.

At least a portion, e.g. 10 to 100 volume %, such as 25 to 75 volume % of the clean synthesis gas in line 141 may be processed by conventional methods to produce substantially all of the hydrogen-rich gas required in the system. Thus, the required amount of clean synthesis gas in line 141 is passed through line 172 into a catalyst in water-gas shift conversion zone 173 where at least a portion of the CO in the gas stream is reacted with $H_2O$ to produce additional $H_2$ and $CO_2$. The remainder of the stream of clean synthesis gas in line 171, if any, is passed through line 174, valve 175, and line 176. This by-product gas stream may be exported for use as synthesis gas, or used to satisfy internal fuel gas requirements. The effluent gas stream from shift conversion zone 173 is passed through line 177 into gas purification zone 178 where unwanted gaseous impurities, e.g., $CO_2$, $H_2O$, $H_2S$, COS, $CH_4$, are removed through line 179. A stream of hydrogen-rich gas, comprising at least 95.0 volume % $H_2$ is removed through line 180, compressed by compressor 181, and recycled through lines 182, 183, valve 184 and lines 185, 19, 15, and 14 where it is mixed with the pumpable coal-liquid hydrocarbon slurry from line 13, as previously described. The remainder of the hydrogen-rich gas stream in line 182 may be exported through line 186, valve 187, and line 188.

EXAMPLE

The following example illustrates an embodiment of the process of this invention as shown in the drawing. While one mode of operation is illustrated, the example should not be construed as limiting the scope the invention. The process is continuous. The quantities are specified on an hourly basis for all streams of materials.

A pumpable coal-liquid hydrocarbon slurry in line 11 is prepared by mixing together the following materials:

From line 1—99.7 parts by weight (pbw) of dried Illinois No. 6 coal ground to a particle size between about ASTM E 11-70 sieve designation standard μm (Nominal Size Opening inches) and having the following Ultimate Analysis (dry basis): Carbon 67.64; Hydrogen 4.77; Nitrogen 0.85; Chlorine 0.05; Sulfur 3.96; Ash 13.41; Oxygen 9.32.

From line 4—0.34 pbw of dried recycle carbon-containing solids derived from line 157.

From line 3—86.25 pbw of liquid hydrocarbon slurry oil from lines 77 and 79 having an API Gravity of 5.0° and an initial boiling point of 500° F. The coal-liquid hydrocarbon slurry is mixed with 4.0 pbw of hydrogen-rich gas comprising 98.0 volume % $H_2$ from line 15. Subsequently in line 37 an additional 24.0 pbw of recycle hydrogen-rich gas from line 28 and 2.0 pbw of hydrogen-rich gas from line 20 are mixed with the slurry.

The catalytic hydrogenation reaction takes place in reactor 45 under the following conditions: temperature of 833° F., hydrogen partial pressure of 1717 psia, space velocity of 24.6 lbs/hr/ft$^3$, and 648 lbs. of dry coal per lb. of catalyst. All of the effluent vapor from reactor 45 is separated in high pressure separation zone 53 into 29.93 pbw of hydrogen-containing gas in line 54 and 186.36 pbw of liquid hydrocarbon in line 66. All of the hydrogen-containing gas in line 54 is separated in hydrogen gas separator 24 into 24 pbw of $H_2$-rich gas comprising 95 mole % $H_2$ in line 26 and 5.93 pbw of $H_2$-containing purge gas in line 33. The stream of hydrogen-containing gas in line 33 has the following composition in mole %: $H_2$ 42.48; CO 4.16; $CH_4$ 33.23; $H_2S$ and COS trace; $N_2$ 3.07; $NH_3$ trace; $C_2H_4$ 0.64; $C_2H_6$ 14.44; $C_3H_6$ 0.02; $C_3H_8$ 1.21; $C_4H_{10}$ 0.04; $CO_2$ 0.01; $H_2O$ 0.70.

About 186.36 pbw of liquid hydrocarbon in line 66 are passed through expansion valve 67, low pressure separator 69, and hydroclone 71 to produce the 86.25 pbw of liquid hydrocarbon slurry oil in line 3, and 40 pbw of liquid hydrocarbon in line 72 which is introduced into vacuum fractionator 76. 22.41 pbw of light liquid hydrocarbon product having an API Gravity of 60.2 and an atmospheric boiling point of 175° F. are removed from light distillate fractionator 100 by way of line 112. 35.23 pbw of middle liquid hydrocarbon product having an API Gravity of 10° and an initial atmospheric boiling point of 450° F. are removed from middistillate fractionator 95 by way of line 96.

About 5.77 pbw of vent gas from light distillate fractionator 100 line 103 are mixed with the purge gas stream of substantially similar composition in line 58 to produce 11.70 pbw of gasifier feed gas in line 59. This gas mixture is passed through burner 62 into synthesis gas generator 60 along with 36.7 pbw of the bottoms from vacuum fractionator 76 in line 84 having an API Gravity of −30° and an initial boiling point of 1000° F. The vacuum bottoms comprise 21.26 pbw of liquid hydrocarbon and 3.46 pbw of unconverted coal and 11.98 pbw of ash. Further, 29.4 pbw of free-oxygen containing gas comprising at least 95 mole % oxygen in line 129 are introduced into gas generator 60. The partial oxidation of the feed in gas generator 60 takes place at a temperature of 2600° F. and a pressure of 90 atmospheres. 93.78 pbw of quench cooled and scrubbed synthesis are produced in line 171 having the following composition in mole %: $H_2$ 24.82; CO 19.28; $CO_2$ 3.28; $H_2O$ 51.74; $N_2$ 0.54; Ar 0.05; $H_2S$ 0.22; COS 0.01; $CH_4$ 0.05; and $NH_3$ 0.001.

About 93.78 pbw of the synthesis gas in line 141 are processed in shift conversion zone 173 and gas purification zone 178 to produce hydrogen-rich make-up gas in line 182. 6.0 pbw of the hydrogen-rich gas from line 183 are fed into line 19, as previously described.

Obviously, various modifications of the invention as hereinbefore set forth may be made without departing from the spirit and scope thereof and therefore, only such limitations should be made as are indicated in the appended claims.

I claim:

1. A process for the liquefaction of ground coal or similar liquefiable carbonaceous solids which comprises:

(1) reacting a preheated slurry mixture comprising dried ground coal or similar liquefiable carbonaceous solids and liquid hydrocarbon slurry oil from (2) (IV), and at least a portion of the hydrogen-rich gas from (4) while in contact with a hydrogenation catalyst in a liquefaction zone at a temperature in the range of about 700° to 950° F., a pressure in the range of about 0 to 300 atmospheres, and a residence time in the range of about 2 to 75 minutes;

(2) separating the effluent stream from the liquefaction zone in (1) into at least the following separate streams by the steps of:

(I) introducing the effluent stream from the liquefaction zone in (1) into a separation zone and separating said effluent stream into the stream of hydrogen-containing gas mixture and a stream of liquid hydrocarbon;

(II) separating a portion of hydrogen-rich gas from said hydrogen-containing gas mixture from (I) to produce a recycle stream of hydrogen-rich gas, and introducing the remainder of the hydrogen-containing gas mixture into the partial oxidation gas generating zone in (3) as a portion of the feed;

(III) reducing the pressure on the stream of liquid hydrocarbon from (I) and separating said stream into hydrocarbon vapors and liquid hydrocarbon oil;

(IV) hydrocloning the liquid hydrocarbon oil from (III) to produce a liquid hydrocarbon slurry oil stream and a underflow liquid hydrocarbon oil stream containing particulate matter;

(V) vacuum distilling a preheated liquid hydrocarbon oil stream containing particulate matter from (IV) in a vacuum fractionating zone thereby forming a stream of vacuum bottoms and a stream of vacuum gas oil vapors; and (VI) fractionating a preheated mixed stream of hydrocarbon vapors from (III) and the vacuum gas oil vapors from (V) thereby forming a vent gas stream of hydrogen-containing gas mixture and at least one stream of liquid hydrocarbon distillate, and introducing said vent gas stream of hydrogen-containing gas mixture into the partial oxidation gas generating zone in (3) as a portion of the feed;

(3) reacting in a partial oxidation gas generating zone the hydrogen-containing gas mixture from (2) (II) less any hydrogen-rich gas separated therefrom, and the vent gas stream of hydrogen-containing gas mixture from (2) (IV), and with or without at least a portion of the vacuum bottoms from (2) (V), with a stream of free-oxygen containing gas, and with or without supplemental temperature moderator, at a reaction temperature in the range of about 1700° to 3000° F. and a pressure in the range of about 1 to 250 atmospheres to produce a stream of hot raw effluent gas comprising $H_2$ and CO, entrained carbon-containing solids, and with or without ash and slag; and (4) cooling and scrubbing with water the hot raw effluent gas stream from (3), and separating carbon-containing solids and any ash and slag from said gas stream thereby obtaining a stream of clean effluent gas comprising $H_2$ and CO, and deriving therefrom a stream of hydrogen-rich gas.

2. The process of claim 1 wherein the mixture in (1) has a solids content in the range of about 50 to 80 wt. %, and the dried ground coal or similar liquefiable carbonaceous solids have a particle size in the range of about 0.0021 to 0.0117 inches.

3. The process of claim 1 wherein the mixture in (1) is previously prepared by mixing said dried ground coal or similar liquefiable carbonaceous solids together with said liquid hydrocarbon slurry oil to provide a pumpable slurry, and mixing said pumpable slurry with said hydrogen-rich gas in the amount of 1,000 to 100,000 Standard Cubic Feet of hydrogen-rich gas per barrel of slurry.

4. The process of claim 1 wherein the mixture in (1) is preheated to a temperature in the range of about 700° and 950° F.

5. The process of claim 3 provided with the step of mixing a hydrogenation catalyst with said mixture of dried ground coal or similar liquefiable carbonaceous solids, liquid hydrocarbon slurry oil, and hydrogen-rich gas.

6. The process of claim 1 wherein the mixture in (1) is previously prepared by mixing together dried ground coal or similar liquefiable carbonaceous solids, liquid hydrocarbon slurry oil, a first portion of compressed hydrogen-rich gas from (4), and with or without hydrogenation catalyst to produce a pumpable slurry; preheating said pumpable slurry; and mixing said preheated pumpable slurry with a preheated hydrogen-rich gas mixture comprising a second portion of compressed hydrogen-rich gas from (4) in admixture with a compressed recycle stream of $H_2$-rich gas from (2) (II).

7. The process of claim 1 provided with the steps of drying at least a portion of the carbon-containing solids from (4), reacting said carbon-containing solids along with said other materials in the liquefaction zone in (1), and reacting the remainder if any of said carbon-containing solids in the partial oxidation gas generating zone as a portion of the feed.

8. The process of claim 1 where the vent gas stream of hydrogen-containing gas mixture in 2 (VI) and separate streams of light and middle hydrocarbon distillates are produced by the steps of fractionating the preheated mixed stream of hydrocarbon vapors from 2 (III) and the vacuum gas oil vapors from 2 (V) in a mid-distillate fractionating zone, thereby providing a bottoms stream of middle hydrocarbon distillate and an overhead stream of hydrocarbon vapors, and preheating and fractionating said overhead stream of hydrocarbon vapors in a light-distillate fractionator thereby producing said vent gas stream of hydrogen-containing gas mixture in 2 (VI) and a separate stream of light hydrocarbon distillate.

9. The process of claim 8 provided with the steps of removing coarse slag from the water used to quench coal and scrub the hot raw effluent gas stream in (4) and thereby providing a dispersion of water and carbon-containing solids, contacting said dispersion with a portion of said light hydrocarbon distillate in a decanting zone, separating a dispersion comprising carbon-containing solids and said light hydrocarbon distillate and a separate stream of water, recycling said separate stream of water to the quench cooling and scrubbing zone, and introducing said dispersion comprising carbon-containing solids and light hydrocarbon distillate into the vacuum fractionating zone in 2 (V) as a portion of the feed.

10. The process of claim 1 provided with the steps of removing coarse slag from the water used to quench cool and scrub the hot raw effluent gas stream in (4) and thereby providing a dispersion of water and carbon-containing solids, and recycling at least a portion of said dispersion with or without concentration of the solids to said partial oxidation gas generating zone in (3), as a portion of the feed.

11. The process of claim 1 where in (4) said stream of hydrogen-rich gas is produced by reacting at least a portion of the clean effluent gas stream comprising $H_2$ and CO in a water-gas shift conversion zone to produce additional $H_2$ and $CO_2$ and removing unwanted gaseous impurities from the effluent gas stream from the shift conversion zone.

12. The process of claim 1 wherein the hydrotreating reaction in (1) takes place in an ebullient bed reactor, and the operating conditions are chosen so as to maintain said slurry mixture and the liquids derived therefrom in substantially liquid phase.

13. The process of claim 1 wherein the hydrogen-containing gas mixture in (2) (I) comprises $H_2$, $H_2S$, COS, $NH_3$, $N_2$, CO, $CO_2$, $H_2O$, and $C_1$–$C_4$ hydrocarbons; liquid hydrocarbon slurry oil in (2) (VI) has a boiling range of about 500°–1050° F.; liquid hydrocarbon distillate in (2) (VI) has a boiling range of about $C_4$-700° F.; and vacuum bottoms in (2) (V) has a boiling range of about 975°–1050+° F.

14. The process of claim 8 wherein said middle hydrocarbon distillate has a boiling range of about 400°–700° F., and said light hydrocarbon distillate has a boiling range of about $C_4$-400° F.

15. The process of claim 1 wherein said coal or similar liquefiable carbonaceous solids is selected from the group consisting of bituminous coal, sub-bituminous coal, anthracite coal, lignite, tar sands, oil shale, peat, and mixtures thereof.

16. The process of claim 1 wherein the hydrogen-rich gas in (1) comprises 95.0 mole % hydrogen, or higher.

17. The process of claim 1 wherein the free-oxygen containing gas in (3) comprises 95.0 mole % oxygen, or higher.

18. The process of claim 1 wherein a supplemental amount of $H_2O$ is introduced into the partial oxidation gas generating zone.

19. The process of claim 1 provided with the steps of introducing and removing hydrogenation catalyst from the liquefaction zone in (1) during said reaction.

20. The process of claim 1 provided with the step of introducing said recycle stream of hydrogen-rich gas from (2) (II) into said liquefaction zone in (1) to provide at least a portion of the hydrogen.

21. In a process for the liquefaction of ground coal or similar liquefiable carbonaceous solids in a slurry with liquid-hydrocarbon oil in a liquefaction reaction zone; separating the effluent from said liquefaction reaction zone in a separation zone into gaseous and liquid fractions including heavy distillates and bottoms; and producing hydrogen-rich gas in a partial oxidation gas generating zone and recycling a portion of said hydrogen-rich gas to said liquefaction reaction zone, the improvement characterized by the steps of:

(I) introducing the effluent stream from said liquefaction zone into a separation zone and separating said effluent stream into a stream of hydrogen-containing gas mixture and a stream of liquid hydrocarbon;

(II) separating a portion of hydrogen-rich gas from said hydrogen-containing gas mixture from I to produce a recycle stream of hydrogen-rich gas, and introducing the remainder of the hydrogen-containing gas mixture into said partial oxidation gas generating zone as a portion of the feed;

(III) reducing the pressure on the stream of liquid hydrocarbon from (I) and separating said stream into hydrocarbon vapors and liquid hydrocarbon oil;

(IV) hydrocloning the liquid hydrocarbon oil from (III) to produce a liquid hydrocarbon slurry oil stream and a liquid hydrocarbon oil stream containing particulate matter;

(V) vacuum distilling a preheated liquid hydrocarbon oil stream from containing particulate matter (IV) in a vacuum fractionating zone thereby forming a stream of vacuum bottoms and a stream of vacuum gas oil vapors; and (VI) fractionating a preheated mixed stream of hydrocarbon vapors from (III) and the vacuum gas oil vapors from (V) thereby froming a vent gas stream of hydrogen-containing gas mixture and at least one stream of liquid hydrocarbon distillate, and introducing said vent gas stream of hydrogen-containing gas mixture into said partial oxidation gas generating zone as a portion of the feed.

22. The process of claim 21 wherein said liquefaction zone comprises at least one hydrotreating reactor with each hydrotreating reactor operating at a temperature in the range of about 750° F. to 950° F., a pressure in the range of about 0 to 300 atmospheres, and a residence time in the range of about 2 to 75 minutes; and wherein the operating conditions are chosen so as to maintain the coal slurry and the dissolved coal in substantially liquid phase.

23. The process of claim 21 wherein a three phase mixture is introduced into said liquefaction zone comprising about 1,000 to 100,000 Standard Cubic Feet of hydrogen-rich gas per barrel of coal or similar liquefiable carbonaceous solids-liquid hydrocarbon oil slurry, with or without admixture with a hydrogenation catalyst.

24. The process of claim 23 provided with the step of mixing said liquid hydrocarbon slurry oil stream from (IV) with ground coal or similar liquefiable carbonaceous solids to provide said slurry.

25. The process of claim 21 wherein a portion of said vacuum bottoms from (V) is introduced into said partial oxidation gas generating zone as a portion of the feed.

* * * * *

UNITED STATES PATENT AND TRADEMARK OFFICE

CERTIFICATE OF CORRECTION

PATENT NO. : 4,523,986

DATED : June 18, 1985

INVENTOR(S) : Frederick B. Seufert

It is certified that error appears in the above—identified patent and that said Letters Patent is hereby corrected as shown below:

Column 12 line 58 change "(VI)" to --(IV)--

Signed and Sealed this

*Twenty-ninth* Day of *October 1985*

[SEAL]

*Attest:*

DONALD J. QUIGG

*Attesting Officer*

*Commissioner of Patents and Trademarks—Designate*